US008888334B2

(12) United States Patent
Hänsch

(10) Patent No.: US 8,888,334 B2
(45) Date of Patent: Nov. 18, 2014

(54) ARRANGEMENT FOR CREATING LIGHT EFFECTS

(75) Inventor: Frauke Susanne Hänsch, Karlsruhe (DE)

(73) Assignee: Ettlin Aktiengesellschaft, Ettlingen (DE)

( * ) Notice: Subject to any disclaimer, the term of this patent is extended or adjusted under 35 U.S.C. 154(b) by 0 days.

(21) Appl. No.: 13/388,549

(22) PCT Filed: Aug. 5, 2010

(86) PCT No.: PCT/EP2010/061402

§ 371 (c)(1),
(2), (4) Date: Feb. 2, 2012

(87) PCT Pub. No.: WO2011/015621

PCT Pub. Date: Feb. 10, 2011

(65) Prior Publication Data

US 2012/0127704 A1 May 24, 2012

(30) Foreign Application Priority Data

Aug. 5, 2009 (EP) ..... 09167249

(51) Int. Cl.

| | |
|---|---|
| ***F21V 1/16*** | (2006.01) |
| ***F21V 11/00*** | (2006.01) |
| ***D03D 9/00*** | (2006.01) |
| ***D03D 19/00*** | (2006.01) |

(52) U.S. Cl.

CPC . *D03D 9/00* (2013.01); *D03D 19/00* (2013.01)
USPC ..... 362/357; 362/311.01; 362/311.03; 362/311.13; 362/225; 362/217.02; 362/236; 362/252; 362/355

(58) Field of Classification Search

USPC ..... 362/311.01, 311.03, 311.13, 362, 16, 362/97.1, 97.4, 219, 222, 223, 225, 217.02, 362/235, 236, 240, 244, 246, 351, 352, 355

See application file for complete search history.

(56) References Cited

U.S. PATENT DOCUMENTS

| | | | | |
|---|---|---|---|---|
| 2,049,251 | A * | 7/1936 | Deitsch | 362/355 |
| 2,886,697 | A * | 5/1959 | Pomeroy | 362/148 |
| 3,790,431 | A * | 2/1974 | Tung | 442/44 |
| 5,763,043 | A * | 6/1998 | Porter et al. | 428/109 |
| 6,435,700 | B1 | 8/2002 | Graham | |
| 7,137,416 | B2 * | 11/2006 | Brochier et al. | 139/420 R |
| 7,190,849 | B2 * | 3/2007 | Katase | 385/2 |

(Continued)

FOREIGN PATENT DOCUMENTS

| | | |
|---|---|---|
| FR | 2 872 563 | 1/2006 |
| JP | 2008 040046 | 2/2008 |

(Continued)

*Primary Examiner* — Thomas M Sember
*Assistant Examiner* — Tsion Tumebo
(74) *Attorney, Agent, or Firm* — Henry M Feiereisen LLC

(57) ABSTRACT

The invention relates to an arrangement for generating light effects, particularly for decorative purposes, having a light source (10) and a textile web material (12) that can be illuminated by through light from the light source (10) toward a visible side (16) or by incident light. According to the invention, the textile web material (12) comprises a two-layer weave structure made of warp threads (18) forming a warp thread layer (26) and weft threads (20) forming a weft thread layer (24) contacting the warp thread layer (26) on one side.

23 Claims, 2 Drawing Sheets

(56) References Cited

U.S. PATENT DOCUMENTS

| | | | | |
|---|---|---|---|---|
| 7,234,853 | B2 | 6/2007 | Givoletti | |
| 7,287,553 | B2 * | 10/2007 | Wahhoud | 139/50 |
| 7,374,315 | B2 | 5/2008 | Dorsey et al. | |
| 7,554,730 | B1 * | 6/2009 | Kuo et al. | 359/443 |
| 7,922,943 | B2 | 4/2011 | Gerking | |
| 8,017,532 | B2 * | 9/2011 | Okada | 442/205 |
| 2004/0037091 | A1 * | 2/2004 | Guy | 362/582 |
| 2008/0151569 | A1 * | 6/2008 | Wang | 362/551 |
| 2010/0029157 | A1 * | 2/2010 | Brochier et al. | 442/168 |

FOREIGN PATENT DOCUMENTS

| | | |
|---|---|---|
| RU | 2 265 089 | 11/2005 |
| RU | 2 287 737 | 11/2006 |
| WO | WO 2006/069562 | 7/2006 |

* cited by examiner

ARRANGEMENT FOR CREATING LIGHT EFFECTS

CROSS-REFERENCES TO RELATED APPLICATIONS

This application is the U.S. National Stage of International Application No. PCT/2010/061402, filed Aug. 5, 2010, which designated the United States and has been published as International Publication No. WO 2011/015621 and which claims the priority of European Patent Application, Serial No. 09167249.3, filed Aug. 5, 2009, pursuant to 35 U.S.C. 119 (a)-(d).

BACKGROUND OF THE INVENTION

The invention relates to an arrangement for creating light effects, in particular for decorative purposes, having a light source and a textile fabric which is transilluminated towards a visible side or illuminated with incident light by the light source.

Such arrangements composed of fabric in plain-weave construction are known as lampshades having a light source arranged behind them. In the case of the plain-weave construction, the crossed warp and weft threads lie alternately over and under one another. In this case, the light source can be seen in a diffusely dimmed manner through the openings in the fabric.

SUMMARY OF THE INVENTION

On this basis, it is the object of the invention to further develop the arrangements known from the prior art and to create lighting units which, in addition to the lighting function and area coverage, also allow a particularly attractive design.

The invention is based on the notion of creating a grid structure that is as free as possible of thread curves for transillumination. Accordingly, it is proposed according to the invention that the textile body has a multi-layer fabric or a two-layer fabric structure made of warp threads that form a warp thread layer and weft threads that form a weft thread layer that rests on one side of the warp thread layer. The two-layer fabric allows a parallel thread orientation in the respective thread layer with a thread density that can be set within wide limits, wherein the threads always rest against one another on the same (inner) thread half side, so that deflection of the impinging light beams to the visible side can be influenced in a targeted manner so as to achieve surprising light effects in the form of a rear-side virtual image.

Advantageous configurations and developments of the invention can be gathered from the dependent claims.

A further improvement in this respect can be achieved in that the warp threads and the weft threads run substantially in a straight line and span in each case a separate plane.

Particularly preferably, the thread density of the weft thread layer is preferably several times greater than the thread density of the warp thread layer. In this way, a large thread surface area for light deflection or reflection is provided, while at the same time a sufficient degree of opening for light to pass through is achieved.

In this context, it is beneficial for the mutual spacing of the weft threads from thread edge to thread edge to be in the range between 0.05 mm and 1 mm, and for the spacing of the warp threads from one another, measured from thread center to thread center, to be between 0.6 mm and 10 mm.

A further advantage with regard to the fabric structure and reflection properties is achieved in that the warp threads and/or the weft threads are formed from a filament yarn which is preferably in the form of a monofilament or—in order to achieve intensified light effects—from a twisted thread or overwrapping yarn. In this case, it is beneficial for the warp threads and/or the weft threads to consist of a polymeric material such as PET, PA, PC, PP, PTFE, PVF, PMMA, PAN or PE or of metal or mineral fibers, such as glass fibers, or inorganic fibers. In this case, the warp threads and/or the weft threads may be transparent or preferably dyed white or black.

Advantageously, the warp threads and the weft threads, which are configured as a continuous yarn, have a diameter in the range between 0.05 and 3 mm, preferably between 0.08 and 1 mm. It is also possible to introduce such weft threads in combination with a spun fiber yarn.

The two-layer fabric structure can be fixed in an advantageous manner in that the warp threads and the weft threads are connected together by binding threads, wherein the binding threads loop around the outsides, which face away from one another, of the warp and weft threads. In this case, it is advantageous for the binding threads to be formed as polymer-based monofilaments or multifilaments, in particular made of PET, PA, PC, PP, PTFE, PVDF, PMAA, PAN or PE, and to have a diameter of less than 0.1 mm.

In order to achieve particularly eye-catching light effects, the light source should be formed by one or more punctiform or linear individual light sources, preferably LEDs. In this case, the individual light sources may be arranged in a linearly, two-dimensionally or spatially distributed manner.

In order to define the light effects in a particular manner, the light source should be arranged at a distance of at least 5 mm from the rear side, which faces away from the visible side, of the textile fabric.

For easier installation, it is advantageous for the textile fabric to be held in a holder such that it is stretched-out flat or is spatially curved. It is also advantageous, in particular with regard to protection from damage and soiling, for the textile fabric to be embedded in a transparent composite or carrier structure. This may take place by embedding between two glass panes by the lamination process or in the casting resin process. Adhesive bonding between two Plexiglass panes or else molding is also possible. The embedded material can be thermally deformed freely so that three-dimensional bodies are produced. Furthermore, carriers can be machined and adhesively bonded in order to produce three-dimensionally extending bodies. One- or two-sided lamination with carrier films is also conceivable, so that a flexible surface similar to the fabric is produced, as a result of which handling is considerably easier.

A further effect enhancement can be achieved in that the textile fabric has a plurality of fabric surfaces that are transilluminated in succession.

Advantageously, the light of the light source will be deflected substantially by the parallel threads in the two thread layers in order to produce a light effect. Such effects can be created in that the textile fabric, as optical unit, produces a virtual image of the light source in the beam path, said virtual image being observable from the visible side. Particularly preferably, the image depth or the spacing of the virtual image from the textile fabric is much greater than the object depth or the spacing of the light source from the textile fabric.

BRIEF DESCRIPTION OF THE DRAWING

The invention is explained in more detail in the following text on the basis of the exemplary embodiments which are illustrated schematically in the drawing, in which.

DETAILED DESCRIPTION OF PREFERRED EMBODIMENTS

Figure 1:
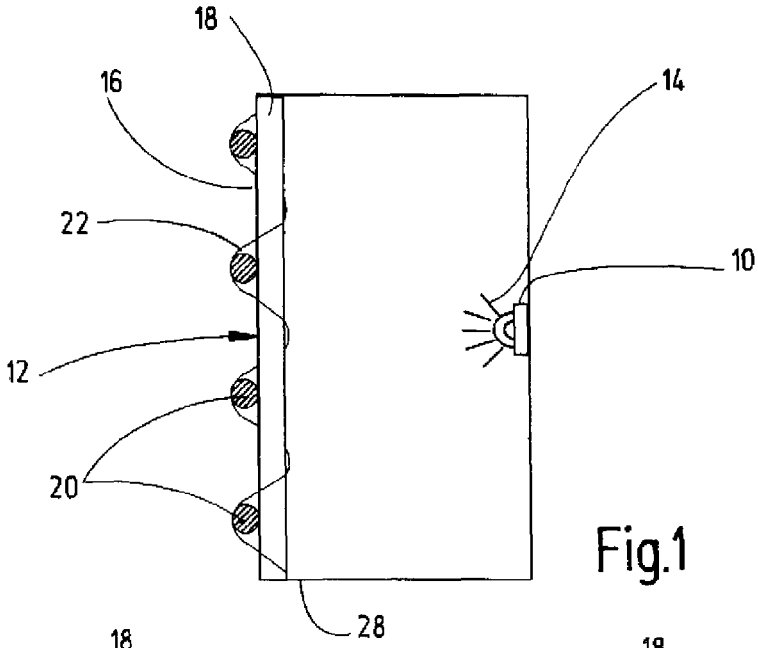
FIG. 1 shows a simplified section through a lighting arrangement comprising a light source and a textile fabric arranged in front of the latter on the visible side.

The lighting arrangement illustrated in the drawing allows the creation of light effects which, in addition to an illuminating function, can also fulfill decorative purposes. The arrangement comprises a light source 10 and a textile fabric 12, which can be transilluminated towards a visible side 16 with the light 14 from the light source 10. When the visible side is observed, a virtual image of the light source 10 is produced in the rear space facing away from the visible side.

In order to create such an effect, the textile fabric 12 consists of a two-dimensionally stretched-out, flat or curved fabric composed of a two-layer grid structure. This is formed according to FIG. 1 from warp threads 18 and weft threads 20 that are crossed at right angles. The core threads 18, 20 are in this case mutually fixed by thin binding threads 22 in a similar manner to a leno weave. For the sake of improved clarity, the thread arrangement is not shown to scale in FIG. 1.

Figure 2:
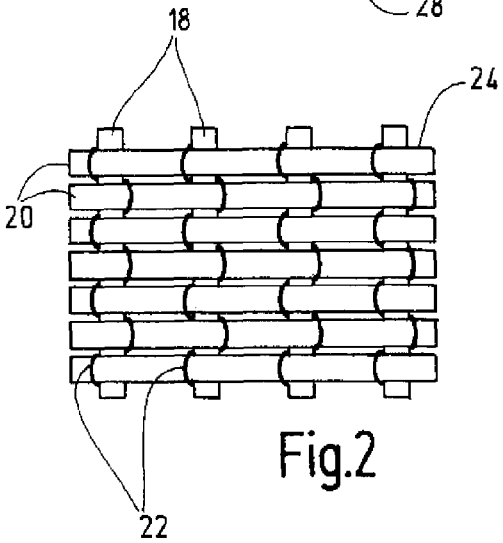
FIGS. 2 and 3 show views of the visible side and of the rear side of a detail of the textile fabric.
Figure 3:
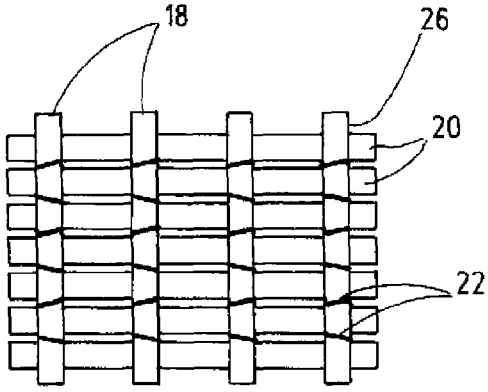

As can also be seen from FIGS. 2 and 3, the warp threads 18 form a planar warp thread layer 26 and the weft threads 20 a separate, planar or spatially separate weft thread layer 24. In order to achieve this, the warp threads 18 and weft threads 20 are arranged in a manner substantially stretched in a straight line, so that the thread layers do not penetrate one another. The core threads 18, 20 are thus always in contact on the same (inner) thread half side, while the binding threads 22 loop around the outsides, which face away from one another, of the core threads 18, 20. If appropriate, the crossing points may additionally be fixed with adhesive.

In order to create particular light effects, the weft threads 20 expediently lie several times closer together than the warp threads 18. For example, the mutual spacing of the weft threads from thread edge to thread edge may be in the range between 0.05 mm and 1 mm, while the spacing of the warp threads from one another, measured from thread center to thread center, is between 0.6 mm and 10 mm. The warp threads and weft threads 18, 20 should in this case have a diameter in the range between 0.05 and 3 mm, expediently between 0.08 and 1 mm, and preferably be formed as monofilaments. The binding threads 22 may, as polymer-based mono- or multifilaments, have a diameter of less than 0.1 mm. A thread cross section that differs from the circular form, for example a trilobal thread cross section, is also conceivable. In such a case, the thread diameter can be defined on a surface of rotation which is obtained by a rotation of the thread cross section about its center axis.

A polymeric material such as PET, PA, PC, PP, PTFE, PVDF, PMAA, PAN or PE is likewise suitable as thread material for the core threads 18, 20. Alternatively, it is also conceivable to use metal threads, glass threads or threads made of inorganic materials. The thread material may be transparent or dyed. Preferably, the weft threads consist of a continuous yarn and are introduced if appropriate in combination with a spun thread yarn. In the warp, combinations with fibrous yarns are also conceivable. In order to achieve particular properties, such as flame protection in particular for use indoors, the fabric can also be treated. The thread materials themselves can also be rendered low flammable by the addition of appropriate additives. In addition to the use for indoors, the properties of the fabric can be set in a targeted manner for use outdoors (UV radiation, moisture, salty air). This is carried out by additives in the yarn or by treating the fabric surface.

The textile fabric 12 can be spanned in a holder, for example a frame 28. The light source 10 can in this case be fastened to the frame 28 or be mounted separately for example on a ceiling or wall. In this case, it should be ensured that the light source 10 has a spacing from the rear of the fabric 12, as seen in the direction of the surface normal, of at least 5 mm, in order to particularly emphasize the light effects. To this end, it is likewise beneficial for the light source 10 to be in the form of a point light source.

Figure 4:
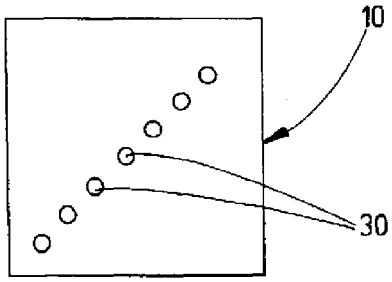
FIGS. 4 and 5 show a linear and two-dimensional distribution of a plurality of point light sources.
Figure 5:
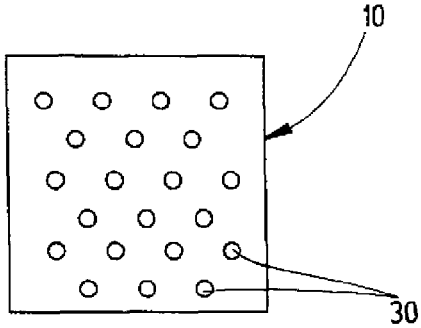

As is shown in the example according to FIGS. 4 and 5, the light source 10 can have a multiplicity of individual light sources 30, which, preferably as light-emitting diodes, form in each case a point light source. The individual light sources 30 can be arranged in a manner distributed linearly (FIG. 4) or two-dimensionally (FIG. 5) in an object plane that extends parallel to the textile fabric 12. However, a varying spacing or an inclined arrangement with regard to the textile 12 is also conceivable. The use of RGB LEDs allows the color of the light effects to be controlled. Complex light effects can be created in that, as textile fabric, a plurality of multi-layer fabrics are arranged one behind another and are jointly transilluminated.

Figure 6:
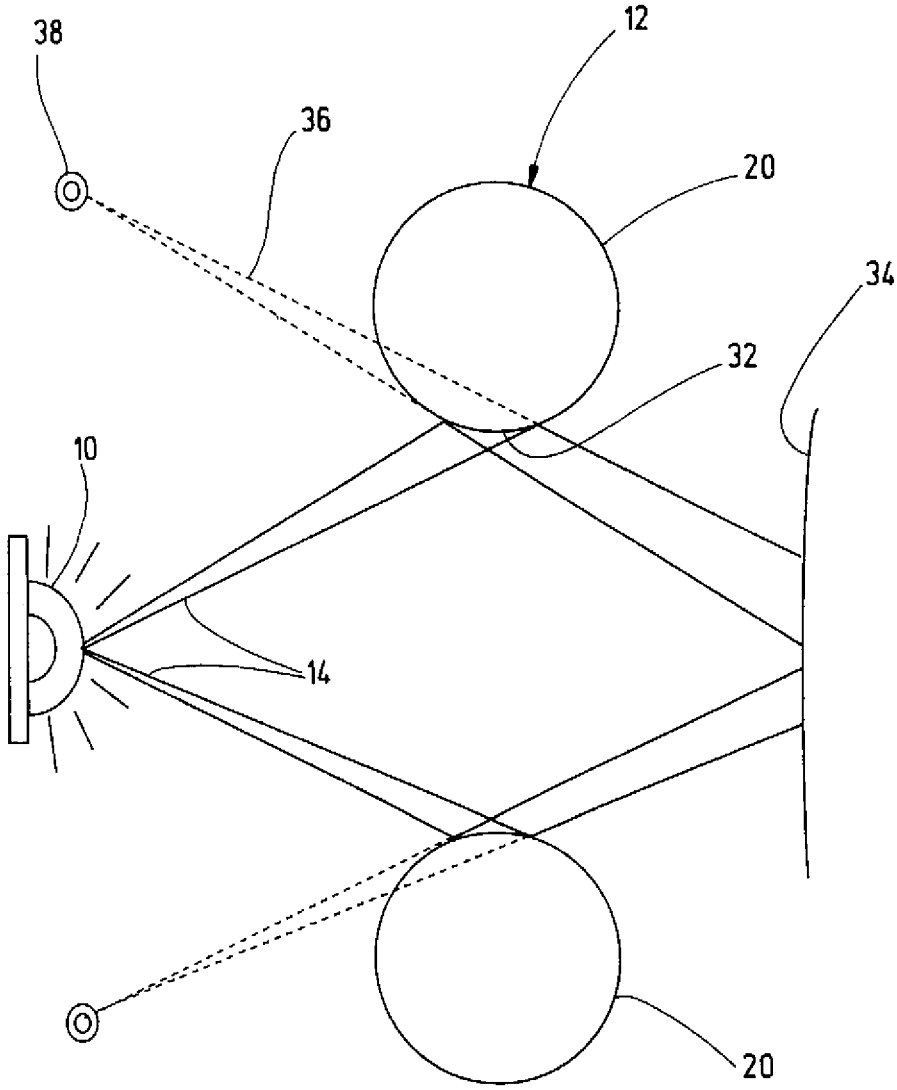
FIG. 6 shows a beam path when the lighting arrangement is observed.

FIG. 6 illustrates the creation of a light effect through the textile fabric in the transmitted-light beam path of the light source 10. In this case, light beams 14 emitted by the light source 10 are deflected by the cylindrical surface 32 of the parallel core threads 18, 20. The close-together weft threads 20 form in this case the primary reflection surface which reflects the beams 14 into the eye 34 of an observer. In the rearward extension 36, there is then produced a virtual image 38 which appears to the observer to be behind the fabric 12. Depending on the thread layer and density, there arise punctiform or linear or grid-like image effects which vary depending on the light source arrangement and orientation and on the location of the observer or angle of observation. In this case, the warp threads 18 or the weft threads 20 can be arranged on the visible side 16 of the fabric 12.

In principle, it is also possible for the light source 10, in addition to the observer, likewise to be arranged on the visible side of the fabric 12 and under incident light to radiate by retroreflection into the eye 34 of the observer. In this case, too, the above-described image effects can be observed with a spatial depth effect of the virtual image behind the fabric surface. For this configuration, what are known as power LEDs are particularly suitable as light source.

The filament yarns (preferably monofilaments) that are used provide good reflective surfaces so that the light is barely scattered. Furthermore, the textile fabric 12, on account of the layer structure and the stretched core threads 18, 20, is characterized in that the good reflective properties of the thread material are retained and that sufficiently free thread surface is available as reflective surface. Furthermore, the fabric has, on account of the stretched thread layer and the different thread densities of the weft and warp layers, sufficiently large openings, through which the reflected light can strike the observer.

In principle, the incident light is reflected at both thread layers 24, 26. Each thread layer creates a light effect perpendicular to the thread axis. The intensity of the light effect created depends on the number of reflective surfaces. On account of the higher weft thread density, the virtual image created by the weft thread layer 24 is also denser and has a higher light intensity. The virtual image created by the warp thread layer 26 can be overlaid to such an extent that it is no longer perceived by the observer. Depending on the thread material, the pure reflection at the surface 32 can be overlaid by refraction. Furthermore, on account of the low thread spacings in the weft direction, bending at the gap may also occur.

A further advantageous possible way of using the textile fabric 12 consists in the use as a projection surface for a projector, for example an overhead projector. In this case, the close-together weft threads 20 should face the projector. In this way, a double function can be achieved, in that, when not in use, the projection surface can be used in a creative manner by being backlit with the light source 10.

The invention claimed is:

1. Arrangement for creating light effects, in particular for decorative purposes, said arrangement comprising:

a light source; and a textile fabric configured for transillumination towards a visible side by the light source, said textile fabric consisting of a two-layer fabric structure made of warp threads that form a warp thread layer and weft threads that form a weft thread layer which rests on one side of the warp thread layer, wherein the weft thread layer has a thread density which is several times greater than a thread density of the warp thread layer, wherein each thread of the weft thread layer has a surface constructed for directional reflection of light emitted by the light source, said reflection generating virtual images of the light source.

2. The arrangement of claim 1, wherein the warp threads and the weft threads run substantially in a straight line and span separate planes, respectively.

3. The arrangement of claim 1, wherein the weft threads are spaced from one another from thread edge to thread edge in a range between 0.05 mm and 1 mm, and wherein the warp threads are spaced from one another, as measured from thread centre to thread centre, in a range between 0.6 mm and 10 mm.

4. The arrangement of claim 1, wherein at least one member selected from the group consisting of the warp threads and the weft threads is formed from a filament yarn.

5. The arrangement of claim 4, wherein the filament yarn is made in the form of a monofilament.

6. The arrangement of claim 1, wherein at least one member selected from the group consisting of the warp threads and the weft threads is made of a polymeric material, metal, mineral fibers, or an inorganic material.

7. The arrangement of claim 6, wherein the polymeric material is selected from the group consisting of PET, PA, PC, PP, PTFE, PVDF, PMMA, PAN and PE.

8. The arrangement of claim 1, wherein at least one member selected from the group consisting of the warp threads and the weft threads is transparent.

9. The arrangement of claim 1, wherein at least one member selected from the group consisting of the warp threads and the weft threads is dyed white or black.

10. The arrangement of claim 1, wherein at least one member selected from the group consisting of the warp threads and the weft threads has a diameter in a range between 0.05 and 3 mm.

11. The arrangement of claim 1, wherein at least one member selected from the group consisting of the warp threads and the weft threads has a diameter in a range between 0.08 and 1 mm.

12. The arrangement of claim 1, wherein the warp threads and the weft threads are connected together by binding threads, wherein the binding threads loop around outsides, which face away from one another, of the warp and weft threads.

13. The arrangement of claim 12, wherein the binding threads are formed as polymer-based monofilaments or multifilaments.

14. The arrangement of claim 13, wherein the binding threads are made of a polymeric material selected from the group consisting of PET, PA, PC, PP, PTFE, PVDF, PMAA, PAN and PE.

15. The arrangement of claim 12, wherein the binding threads have a diameter of less than 0.1 mm.

16. The arrangement of claim 1, wherein the light source comprises one or more punctiform or linear individual light sources.

17. The arrangement of claim 1, wherein the light source comprises LEDs.

18. The arrangement of claim 1, wherein the light source has a plurality of individual light sources arranged in a linearly, two-dimensionally or spatially distributed manner.

19. The arrangement of claim 1, wherein the light source is arranged at a distance of at least 5 mm from a rear side of the textile fabric, which rear side faces away from the visible side.

20. The arrangement of claim 1, further comprising a holder to hold the textile fabric such that the textile fabric is stretched-out flat or is spatially curved.

21. The arrangement of claim 20, wherein the holder has a frame-shaped configuration.

22. The arrangement of claim 1, wherein the textile fabric is embedded in a transparent composite structure.

23. The arrangement of claim 1, wherein the weft threads are arranged parallel to one another, thereby causing a line-shaped arrangement of the virtual images relative to one another.

* * * * *